US006743051B2

(12) United States Patent
Hayashi

(10) Patent No.: US 6,743,051 B2
(45) Date of Patent: Jun. 1, 2004

(54) ELECTRICAL CONNECTOR ASSEMBLY

(75) Inventor: Toshiaki Hayashi, Aichi (JP)

(73) Assignee: Tyco Electronics AMP K.K., Kawasaki (JP)

( * ) Notice: Subject to any disclaimer, the term of this patent is extended or adjusted under 35 U.S.C. 154(b) by 18 days.

(21) Appl. No.: 10/374,804

(22) Filed: Feb. 25, 2003

(65) Prior Publication Data

US 2003/0162444 A1 Aug. 28, 2003

(30) Foreign Application Priority Data

Feb. 25, 2002 (JP) ..... 2002-047385

(51) Int. Cl.[7] ..... H01R 13/66
(52) U.S. Cl. ..... 439/620; 439/352
(58) Field of Search ..... 439/620, 352, 439/489, 188

(56) References Cited

U.S. PATENT DOCUMENTS 5,435,742 A * 7/1995 Cecil, Jr. ..... 439/347
5,435,754 A * 7/1995 Hotea et al. ..... 439/620
5,489,220 A * 2/1996 Hanna et al. ..... 439/620
5,529,512 A * 6/1996 Mlyniec ..... 439/352
5,575,681 A * 11/1996 Muzslay et al. ..... 439/459
5,586,902 A * 12/1996 Hopf et al. ..... 439/352
5,586,903 A * 12/1996 Hoffmann ..... 439/352
5,591,041 A * 1/1997 Cecil et al. ..... 439/352
5,609,498 A * 3/1997 Muzslay ..... 439/352
5,613,865 A * 3/1997 Dullin et al. ..... 439/188
5,616,045 A * 4/1997 Gauker ..... 439/352
5,647,757 A * 7/1997 Chrysostomou ..... 439/352
5,685,743 A * 11/1997 Schmidt et al. ..... 439/701
5,688,141 A * 11/1997 Dullin ..... 439/352
5,746,618 A * 5/1998 Gauker ..... 439/352
5,772,460 A * 6/1998 Baumann ..... 439/352
5,816,840 A * 10/1998 Dullin ..... 439/352
5,827,083 A * 10/1998 Dullin ..... 439/188
5,853,298 A * 12/1998 Pacher ..... 439/352
5,863,214 A * 1/1999 Hanak ..... 439/352
5,876,231 A * 3/1999 Pacher ..... 439/354
5,895,282 A 4/1999 Little ..... 439/332
5,921,800 A * 7/1999 Liebich ..... 439/354
5,924,885 A * 7/1999 Pacher ..... 439/352
5,955,699 A * 9/1999 Perotto et al. ..... 102/530
5,993,230 A * 11/1999 Gauker et al. ..... 439/188
6,019,638 A * 2/2000 Saka et al. ..... 439/620
6,033,256 A * 3/2000 Odorfer ..... 439/465
6,062,909 A * 5/2000 Zeller et al. ..... 439/620
6,083,057 A * 7/2000 Annecke et al. ..... 439/752
6,102,732 A * 8/2000 Seko et al. ..... 439/489
6,146,598 A * 11/2000 Duvacquier et al. ..... 422/166
6,149,448 A * 11/2000 Haller et al. ..... 439/188
6,152,775 A * 11/2000 Pavlovic ..... 439/620
6,203,342 B1 * 3/2001 Gauker et al. ..... 439/188
6,217,388 B1 * 4/2001 Francis ..... 439/620

(List continued on next page.)

OTHER PUBLICATIONS

European Search Report dated Jun. 3, 2003.

*Primary Examiner*—Ross Gushi
(74) *Attorney, Agent, or Firm*—Harley, Snyder, Senft & Cohen, LLC

(57) ABSTRACT

An electrical connector assembly that has an insulative housing for holding an electrical contact that is connected to a wire. A ferrite member is arranged in the insulative housing. The ferrite member includes a first piece and a second piece. The first piece and the second piece each have a groove that forms a wire receiving aperture when the first piece and the second piece are positioned adjacent to each other. An elastic portion is arranged in the insulative housing. The elastic portion urges the first piece toward the second piece so that the first piece is pressed against the second piece in a manner that prevents gaps from forming therebetween.

19 Claims, 2 Drawing Sheets

U.S. PATENT DOCUMENTS 6,234,814 B1 * 5/2001 Hirschmann ..... 439/188
6,234,843 B1 * 5/2001 Pavlovic ..... 439/620
6,250,952 B1 * 6/2001 Shiga et al. ..... 439/466
6,254,419 B1 * 7/2001 Hirschmann et al. ..... 439/372
6,276,953 B1 * 8/2001 Gauker et al. ..... 439/352
6,276,957 B1 * 8/2001 Seko et al. ..... 439/489
6,283,794 B1 9/2001 Osuga ..... 439/620
6,287,139 B1 * 9/2001 Seko et al. ..... 439/489
6,328,589 B1 * 12/2001 Annecke ..... 439/352
6,341,972 B1 * 1/2002 Odorfer ..... 439/352
6,364,683 B1 * 4/2002 Kohno ..... 439/352
6,419,510 B2 * 7/2002 Shiraki et al. ..... 439/188
6,435,894 B2 * 8/2002 Little et al. ..... 439/352
6,439,914 B2 * 8/2002 Nimura ..... 439/352
6,461,184 B2 * 10/2002 Nimura ..... 439/352
6,488,518 B2 * 12/2002 Mlyniec ..... 439/180
6,530,799 B2 * 3/2003 Regnier et al. ..... 439/352
6,551,137 B2 * 4/2003 Pfaff et al. ..... 439/607
6,609,931 B2 * 8/2003 Parrish et al. ..... 439/578
6,623,275 B1 * 9/2003 Pavlovic et al. ..... 439/38

* cited by examiner

ELECTRICAL CONNECTOR ASSEMBLY

FIELD OF THE INVENTION

The invention relates to an electrical connector assembly and, more particularly, to an electrical connector assembly that has a ferrite member for the reduction of noise.

BACKGROUND OF THE INVENTION

Noise reduction techniques for suppressing noise in electrical paths are well known. For example, with regard to electrical paths that operate air bags used in automobiles to protect passengers during impact, reduction of exterior noise is accomplished by employing noise reduction elements. The noise reduction elements prevent the igniter systems of the air bags from being triggered by noise that inflates the air bags inadvertently. Ferrite members are commonly provided as noise reduction elements within electrical connectors in these electrical paths.

One example of such a ferrite member for an electrical fuse ignition connector is disclosed in U.S. Pat. No. 6,283,794. The electrical fuse ignition connector has a single ferrite member with two apertures that acts as a noise reduction element. Wires, which are connected to electrical contacts of the electrical fuse ignition connector, are inserted through the two apertures. In this electrical fuse ignition connector, the apertures in the ferrite member are set to be only slightly larger than the diameters of the wires so that the noise reduction effect is increased. Because the diameters of the apertures are relatively small, it is difficult to insert the wires through the apertures in the ferrite member, causing a problem with workability during assembly. However, in cases where the apertures are made bigger to ease the insertion of the wires therethrough, the noise reduction effect is diminished.

Another example of a ferrite member for an electrical connector assembly for air bags is disclosed in U.S. Pat. No. 5,895,282. The electrical connector assembly has a two-piece ferrite member with two grooves formed in each of the ferrite members. When the ferrite members are joined with each other, the grooves match up to form two apertures. Wires connected to the connector assembly are arranged within the apertures. In this connector assembly, there is a risk that a gap will be formed between the two pieces of the ferrite member due to dimensional tolerances occurring during manufacture thereof. The gap would diminish the noise reduction effect. In addition, audible noise may be generated by the two pieces of the ferrite member striking each other due to vibration or impact. There is also a risk that this vibration or impact will damage the two pieces of the ferrite member.

SUMMARY OF THE INVENTION

It is an object of the present invention to provide an electrical connector assembly which is easy to assemble, positively obtains a noise reduction effect, and poses little risk of damage to the ferrite members even if vibration or impact is imparted thereto. This and other objects are achieved by an electrical connector assembly that has am insulative housing that holds an electrical contact connected to a wire. A ferrite member is arranged in the insulative housing. The ferrite member includes a first piece and a second piece configured to receive the wire that is connected to the electrical contact. An elastic portion is arranged in the insulative housing. The elastic portion urges the first piece toward the second piece so that the first piece is pressed against the second piece in a manner that prevents gaps from forming therebetween.

DESCRIPTION OF THE PREFERRED EMBODIMENTS

Figure 1:
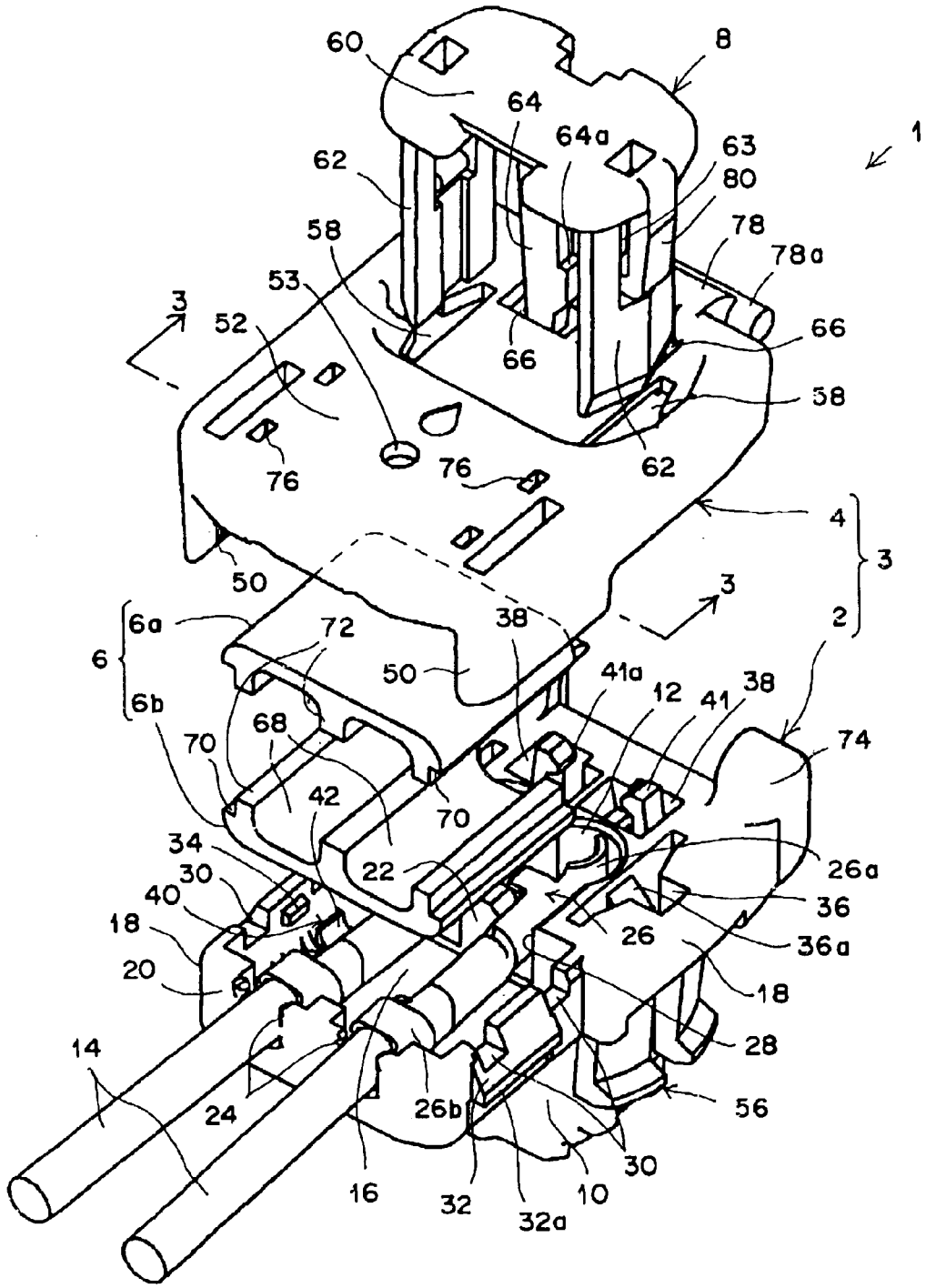
FIG. 1 is an exploded perspective view of an electrical connector assembly.

As shown in FIG. 1, electrical connector assembly 1 includes an insulative housing 3, electrical contacts 26, a locking button 8 or Connector Position Assurance Device (CPA), and a ferrite member 6. The insulative housing 3 is constructed of an upper housing 4 and a lower housing 2. The upper housing 4 and the lower housing 2 are of a substantially rectangular shape when viewed from above. The ferrite member 6 is arranged between the upper housing 4 and the lower housing 2 and includes an upper ferrite member 6*a* and a lower ferrite member 6*b*, which are vertically separated. The individual components of the electrical connector assembly 1 will be described in greater detail herein. The side of the assembly 1 at which wires 14 are inserted will be referred to as a front side thereof, and the side opposite to the front side will be referred to as a rear side thereof. In addition, references to the sides up, down, left, and right are as shown in FIG. 1.

Figure 2:
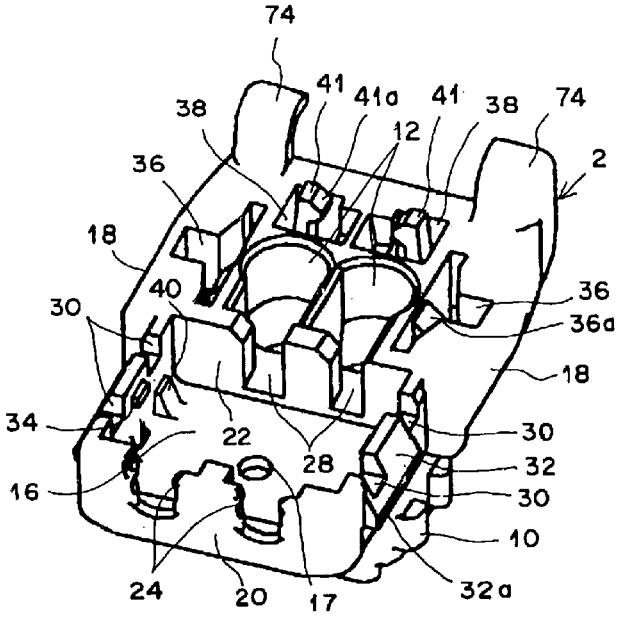
FIG. 2 is a perspective view of a lower housing of the electrical connector assembly of FIG. 1.
Figure 3:
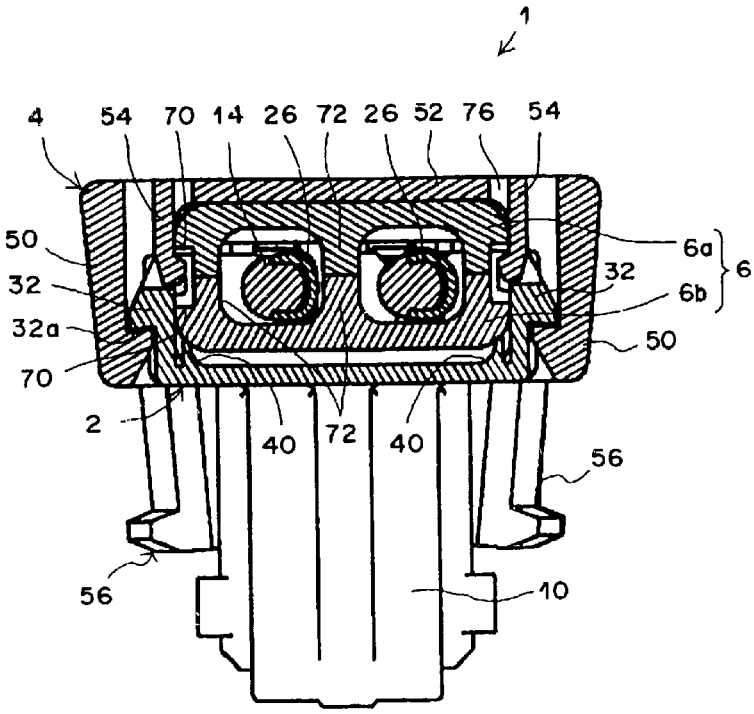
FIG. 3 is a magnified cross-sectional view of the electrical connector assembly of FIG. 1 in an assembled state along line 3—3 of FIG. 1.

The lower housing 2 will now be described in greater detail. As shown in FIGS. 1 and 3, the lower housing 2 has an engagement protrusion 10 that extends downward from a central portion thereof. The engagement protrusion 10 may engage another connector on a side of a device (not shown) such as an air bag. As best shown in FIG. 2, a pair of vertically extending contact housing apertures 12 is formed at the central portion of the lower housing 2. The contact housing apertures 12 penetrate through the engagement protrusion 10. A substantially rectangular recess 16 for placing the ferrite member 6 is formed toward a front of the contact housing apertures 12. The recess 16 is defined by a front wall 20, portions of side walls 18 and a central wall 22 in a vicinity of the contact housing apertures 12. A pair of cutouts 24 for receiving wires 14 is formed in the front wall 20. A pair of cutouts 28 for housing contacts 26 is formed in the central wall 22 and is separated in a horizontal direction.

As shown in FIG. 2, a pair of cutouts 30, separated in a front to back direction, is formed on each of the side walls 18 that define the recess 16 at portions toward the front wall 20 thereof. Engagement protrusions 32 are formed between the cutouts 30. The engagement protrusions 32 are inclined toward an exterior of the housing 3 and have downward facing shoulders 32*a*. Holding protrusions 34 are formed integrally with the engagement protrusions 32 on interior sides thereof and on the side of the recess 16 to prevent extraction of the lower ferrite member 6*b*.

As shown in FIGS. 1 and 2, upward facing tapered ribs or elastic portions 40 are provided substantially parallel to the wires 14 on a flat bottom surface of the recess 16. The ribs 40 are positioned slightly toward the interior relative to the engagement protrusions 32. Exterior sides of the ribs 40, that is, the sides closer to the engagement protrusions 32, are substantially vertical, and interior sides of the ribs 40 have slightly inclined planes 42. The cross-sectional form of the ribs 40 is substantially triangular. The ribs 40 are formed integrally with the lower housing 3 and have a thickness, shape, and height that possesses elasticity. The ribs 40 are structured to elastically support the lower ferrite member 6*b*.

As shown in FIG. 2, the bottom surface of the recess 16 has an inspection window 17. The inspection window 17 is formed through the approximate center of the recess 16. The inspection window 17 serves to confirm whether the lower ferrite member 6*b* has been properly mounted after completion of the assembly 1.

As shown in FIG. 2, T-shaped openings 36 extend vertically through the lower housing 2 on both sides of the contact housing apertures 12. Latch protrusions 36*a* having downward facing shoulders (not shown) are formed on interior surfaces of the T-shaped openings 36. As shown in FIG. 2, downwardly extending engagement legs 56 are integrally formed with the lower housing 2, adjacent to the T-shaped openings 36 and to the exterior thereof. The engagement legs 56 are capable of elastically deforming in the horizontal direction and are inclined slightly toward the interior 3, as best shown in FIG. 3, so that the engagement legs 56 latch with the other connector when the assembly 1 engages with the other connector and maintains the engagement therebetween. The structure of the engagement legs 56 reduces the insertion resistance of the assembly 1 with respect to the other connector.

As shown in FIG. 2, a pair of horizontally separated openings 38 is formed to the rear of the contact housing apertures 12. An upwardly extending latch arm 41 is formed within each of the horizontally separated openings 38. Each of the latch arms 41 has an inwardly extending protrusion 41*a*. Upwardly protruding ear portions 74 are integrally formed with the lower housing 2 behind the openings 38. Horizontal grooves (not shown) are formed on the rear sides of each of the ear portions 74. The grooves (not shown) serve as engagement portions with the upper housing 4.

The contacts 26 will now be described in greater detail. As shown in FIG. 1, the contacts 26 are substantially L-shaped in configuration. The contacts 26 have contact portions 26*a* and crimping portions 26*b*. The contact portions 26*a* are arranged within the contact housing apertures 12. The crimping portions 26*b* are crimped to the wires 14.

The upper housing 4 will now be described in greater detail. The upper housing 4 is structured to be combined with the lower housing 2. As shown in FIGS. 1 and 3, the upper housing 4 has latch arms 50 corresponding to the engagement protrusions 32 of the lower housing 2 that extend from the upper housing 4 for engagement thereto. As best shown in FIG. 3, four downwardly extending holding arms 54 extend from an upper wall 52 of the housing 4 for holding both sides of the upper ferrite member. The holding arms 54 are formed on exterior sides of rectangular apertures 76 formed in the upper wall 52. Tips of the holding arms 54 are positioned within the cutouts 30 of the lower housing 2 after assembly of the housing 3.

As shown in FIG. 1, openings 58 extend vertically through the upper housing 4 at positions corresponding to the T-shaped openings 36. Apertures 66 are formed at positions corresponding to the latch arms 41 and rearward of the openings 58. A web 78 is formed at the rear edge of the upper housing 4. Protrusions 78*a* for engaging the grooves of the ear portions 74 are formed at lateral sides of a distal end of the web 78. An inspection window 53 extends through a top surface of the upper housing 4 in substantially the same manner as the inspection window 17. The inspection window 53 serves to confirm whether the upper ferrite member 6*a* has been properly mounted.

The ferrite member 6 will now be described in greater detail. As shown in FIG. 1, the ferrite member 6 is arranged between the upper housing 4 and the lower housing 2. For simplicity, FIG. 1 illustrates the ferrite member 6 as two pieces that face each other above the wires 14, in actuality, the lower ferrite member 6*b* is positioned beneath the wires 14. The upper ferrite member 6*a* and the lower ferrite member 6*b* are of substantially the same construction and are positioned above and below the wires 14 in reverse orientation. The lower ferrite member 6 will, therefore, be described in greater detail herein with the understanding that the upper ferrite member 6*a* is of substantially the same construction.

As shown in FIG. 1, the lower ferrite member 6*b* has two grooves 68 defined by three protrusive ribs 72. The grooves 68 are provided for arranging the contacts 26 to which the wires 14 have been crimped therein. Step portions 70 extend on both exterior sides along the grooves 68. The step portions 70 on the lower ferrite member 6*b* engage with the holding protrusions 34 of the recess 16 to prevent the lower ferrite member 6*b* from being extracted upwardly from the recess 16 of the lower housing 2. The step portions 70 on the upper ferrite member 6*a* engage with the holding arms 54 of the upper housing 4. When the upper and lower ferrite members 6*a*, 6*b* are placed adjacent to each other, the grooves 68 form apertures that house the contacts 26.

The CPA 8 will now be described in greater detail. The CPA 8 is formed as an integral structure from resin. The CPA 8 has a planar pressing portion 60. A pair of tongue pieces 62 and a pair of engagement protrusion pieces 64 structured to pass through the apertures 66 of the upper housing 4 extend from the pressing portion 60. The engagement protrusion pieces 64 have upward facing shoulders 64*a* on interior sides. Latch arms 80 extend downward from the pressing portion 60 within openings 63 provided in the tongue pieces 62 at both lateral edges thereof.

The assembly of the electrical connector assembly 1 will now be described in greater detail. As shown in FIG. 1, when mounting the upper housing 4 onto the lower housing 2, the protrusions 78*a* are engaged within the grooves of the ear portions 74. The front edge of the upper housing 4 is rotated toward the lower housing 2 using the engaged portion as the center of rotation.

When the lower ferrite member 6*b* is placed within the recess 16, the ribs 40 abut arcuate edges of lateral lower sides of the lower ferrite member 6*b* and elastically urge the lower ferrite member 6*b* upward. Accordingly, when the upper ferrite member 6*a* held by the upper housing 4 is combined with the lower ferrite member 6*b* held by the lower housing 2 by engagement of the upper housing 4 and the lower housing 2, the lower ferrite member 6*b* is urged upward by the ribs 40. In effect, the upper ferrite member 6*a* is pressed against the upper wall 52 of the upper housing 4. Thus, each of the protrusive ribs 72 of the lower ferrite member 6*b* and the upper ferrite member 6*a* abut each other such that there are no gaps therebetween. As a result, the operational effect of the ferrite member 6 as a noise reduction element is sufficiently exhibited, audible noise is prevented from being generated when vibrations are imparted thereto, and the risk of damage to the ferrite member 6 in the case that an external shock is applied is reduced. In addition, the assembly of the electrical connector assembly 1 is facilitated, because the lower housing 2 that holds the lower ferrite member 6*b* is simply combined with the upper housing 4 which holds the upper ferrite member 6*a*.

The CPA 8 is temporarily mounted on the upper housing 4 by the engagement protrusion pieces 64. The shoulders 64*a* temporarily engage with engagement portions (not shown) within the openings 66. At this time, if the engagement protrusion pieces 64 open outwardly, the CPA 8 will be inadvertently completely inserted into the upper housing 4, thereby preventing the engagement legs 56 from flexing inwardly. If this occurs, then engagement with the other connector becomes impossible. Therefore, the latch arms 41 press the engagement protrusion pieces 64 from the outside, to prevent them from flexing outwardly. By this construction, the CPA 8 can be prevented from being inadvertently completely mounted on the upper housing 4.

After the housing 3 is assembled, the CPA 8 is pressed against the upper housing 4 so that the planar pressing portion 60 is positioned adjacent to the top surface of the upper housing 4. The tongue pieces 62 enter the T-shaped openings 36. The tongue pieces 62 spread the engagement legs 56 outward. By this flexure, the engagement legs 56, which are engaged with the other connector, are prevented from moving in an engagement release direction, that is, toward the interior and, thereby, the engagement between the connectors is positively maintained. When the CPA 8 is fully inserted into the upper housing 4, the latch arms 80 engage with the latch protrusions 36*a* of the lower housing 2.

The electrical connector assembly of the present invention has been described in detail herein. However, the present invention is not limited to the embodiment described. It goes without saying that various changes and modifications are possible within the scope and spirit of the invention. For example, the ribs 40 are not limited to being provided within the lower housing 2, alternatively, the ribs 40 may be provided in the upper housing 4 to urge the ferrite member 6 downward. The ribs 40 may also be provided as separate units from the lower housing 2. In addition, the elastic portion is not limited to being ribs. Any desired shape may be adopted, as long as it is a shape that enables pressure to be applied to the ferrite member 6. It is, therefore, intended that the foregoing description be regarded as illustrative rather than limiting, and that the scope of the invention is given by the appended claims together with their full range of equivalents.

What is claimed is:

1. An electrical connector assembly, comprising:

an insulative housing for holding an electrical contact that is connected to a wire;

a ferrite member arranged in the insulative housing, the ferrite member includes a first piece and a second piece configured to receive the wire that is connected to the electrical contact; and an elastic portion arranged in the insulative housing that urges the first piece toward the second piece so that the first piece is pressed against the second piece in a manner that prevents gaps from forming therebetween.

2. The electrical connector assembly of claim 1, wherein the elastic portion is a rib, the rib having an inclined surface that supports the first piece.

3. The electrical connector assembly of claim 1, wherein the insulative housing includes an inspection window for confirming the correct positioning of the ferrite member.

4. The electrical connector assembly of claim 1, further comprising a connector position assurance device that positively maintains an engagement between the insulative housing and another electrical connector.

5. The electrical connector assembly of claim 1, wherein the first piece and the second piece are of identical construction.

6. The electrical connector assembly of claim 1, wherein the elastic portion is integrally formed with the insulative housing.

7. The electrical connector assembly of claim 1, wherein the first piece is arranged in a lower part of the housing and the second piece is arranged in an upper part of the housing such that when the lower part of the housing and the upper part of the housing are joined the first piece and the second piece are positioned adjacent to each other.

8. The electrical connector assembly of claim 7, wherein the upper housing was holding arms extending thereform for holding the second piece.

9. The electrical connector assembly of claim 7, wherein the lower housing includes protrusions that prevent the first piece from being extracted from the lower housing.

10. An electrical connector assembly, comprising:

an insulative housing for holding an electrical contact that is connected to a wire;

a ferrite member arranged in the insulative housing, the ferrite member includes a first piece and a second piece, the first piece and the second piece each having a groove that forms a wire receiving aperture when the first piece and the second piece are positioned adjacent to each other; and an elastic portion arranged in the insulative housing that urges the first piece toward the second piece so that the first piece is pressed against the second piece in a manner that prevents gaps from forming therebetween.

11. The electrical connector assembly of claim 10, wherein the elastic portion is a rib, the rib having an inclined surface that supports the first piece.

12. The electrical connector assembly of claim 10, wherein the rib is integrally formed with the insulative housing.

13. The electrical connector assembly of claim 10, wherein the insulative housing includes an inspection window for confirming the correct positioning of the ferrite member.

14. The electrical connector assembly of claim 10, further comprising a connector position assurance device that positively maintains an engagement between the insulative housing and another electrical connector.

15. The electrical connector assembly of claim 10, wherein the first piece and the second piece are of identical construction.

16. The electrical connector assembly of claim 10, wherein the first piece is arranged in a lower part of the housing and the second piece is arranged in an upper part of the housing such that when the lower part of the housing and the upper part of the housing are joined the first piece and the second piece are positioned adjacent to each other.

17. The electrical connector assembly of claim 16, wherein the upper housing includes holding arms extending thereform for holding the second piece.

18. The electrical connector assembly of claim 17, wherein the lower housing includes protrusions that prevent the first piece from being extracted from the lower housing.

19. The electrical connector assembly of claim 18, wherein the first and second pieces include step portions that are engaged by the holding arms and the protrusions.

* * * * *

UNITED STATES PATENT AND TRADEMARK OFFICE

CERTIFICATE OF CORRECTION

PATENT NO. : 6,743,051 B2
DATED : June 1, 2004
INVENTOR(S) : Toshiaki Hayashi

It is certified that error appears in the above-identified patent and that said Letters Patent is hereby corrected as shown below:

Column 6,
Line 14, “thereform” should read -- therefrom --.
Line 59, “thereform” should read -- therefrom --.

Signed and Sealed this

Twenty-first Day of December, 2004

JON W. DUDAS
*Director of the United States Patent and Trademark Office*